United States Patent [19]

Hydorn

[11] Patent Number: 4,694,503

[45] Date of Patent: Sep. 15, 1987

[54] CONTROL TOP BAG

[76] Inventor: Dennis Hydorn, 1260 Caledonia Road, Toronto, Ontario, Canada, M6A 2X5

[21] Appl. No.: 841,812

[22] Filed: Mar. 20, 1986

[51] Int. Cl.[4] ..... B65D 33/06

[52] U.S. Cl. ..... 383/12; 383/9; 383/24; 248/99; 248/100

[58] Field of Search ..... 383/12, 9, 24, 33, 22, 383/72, 73, 74, 43, 6, 23, 75; 248/99, 100, 101, 359 G

[56] References Cited

U.S. PATENT DOCUMENTS

| | | | |
|---|---|---|---|
| 690,412 | 1/1902 | Erickson | 248/99 |
| 1,378,607 | 5/1921 | Norton | 248/99 |
| 2,078,438 | 4/1937 | Baxter | 248/100 |
| 2,903,215 | 9/1959 | Metcalf | 248/99 |
| 3,180,384 | 4/1965 | Seifert | 383/12 |
| 3,847,332 | 11/1974 | Murai | 248/99 |
| 4,050,492 | 9/1977 | Veilleux | 383/12 |

FOREIGN PATENT DOCUMENTS

| | | | |
|---|---|---|---|
| 2605834 | 8/1977 | Fed. Rep. of Germany | 383/23 |

*Primary Examiner*—Willis Little
*Attorney, Agent, or Firm*—Ivor M. Hughes

[57] ABSTRACT

A fabric laundry bag is combined with a support for supporting the mouth of the bag in an open substantially horizontal plane. The support has a pair of parallel arms spaced from each other by a connector, the connector carrying a hanger. The laundry bag has a sleeve proximate the mouth for receiving the spaced arms of the support. The plane of the hanger in relation to the plane in which the arms are disposed in slightly less than 90 degrees, whereby when the hanger is hung, for example on a door knob, the spaced arms are oriented in a substantially horizontal plane thereby presenting the mouth of the laundry bag in a substantially horizontal plane.

2 Claims, 8 Drawing Figures

CONTROL TOP BAG

FIELD OF INVENTION

This invention relates to an improved laundry bag and components therefor.

BACKGROUND OF THE INVENTION

Laundry bags composed of natural or synthetic fabric may be designed to serve both as an open laundry receptacle for receiving soiled clothes and as a bag for transporting the soiled clothes to laundry facilities (for example, a dry cleaning establishment). If the mouth of the bag when used as a laundry bag is unsupported, the bag will not present an open mouth through which the soiled laundry can be easily deposited.

It is therefore useful to suppport the mouth of the laundry bag by a hanger (for example, from any doorknob or hook) to present an open mouth for the deposit of laundry. However, where the usual bags are supported in a manner to present an open mouth, the mouth is not easily accessible.

It is therefore an object of this invention, to provide an improved laundry bag which overcomes the deficiencies of the prior structures.

Further and other objects of this invention will be realized by those skilled in the art from the following summary of the invention and detailed description of an embodiment thereof.

SUMMARY OF THE INVENTION

According to one aspect of the invention, an improved laundry bag is provided comprised of fabric, plastics or other suitable material and a support for carrying the bag so that the bag depends freely from the support, the support having a pair of parallel arms spaced from each other by a connector, the connector carrying a hanger for hanging the laundry bag, the laundry bag carrying at least one sleeve proximate the mouth of the laundry bag and preferably a pair of sleeves proximate the mouth of the laundry bag for receiving the spaced arms, the plane of the hanger and the plane in which the arms are disposed creating an angle of slightly less than 90 degrees for example about 80° degrees whereby when the hanger is carried by a carrier such as a hook or door knob, the spaced arms are oriented in a substantially horizontal plane, thereby presenting the mouth of the laundry bag in a substantially horizontal plane.

Preferably, the hanger incorporates a loop formed by bending the centre of the connector and preferably the loop is of a diameter at least greater than the diameter of the usual doorknob.

Preferably, the laundry bag material is folded over at its mouth and stitched so as to form a generally continuous sleeve or tubular channel and one of the portions of the folded over sleeve is slit providing two adjacent openings into the sleeve or tubular channel through which the arms are inserted. In this regard, the material on both sides of the slit is stretched to accomodate the arms. A zipper may be provided in the bag to open proximate the slit opening to permit the material to be pushed apart to permit entry of the arms into the two adjacent openings in the sleeve. Therefore, after each of the arms is inserted into the sleeve the material of the sleeve is pulled along the connector from each side towards the hanger. Preferably, the two spaced parallel arms of the hanger may comprise metal (for example, steel) and the ends of the arms may carry rubber or plastic tips to protect the material of the laundry bag.

Preferably, the angle between the planes of the hanger and arms is between about 80° degrees and slightly less than 90° degrees.

Preferably, the arms, connector and hanger comprise a continuous steel rod bent to provide a hanger loop and the arms.

In one embodiment, when the support is removed from the sleeve the bag mouth may be drawn closed by means of a cinching cord also carried inside the sleeve or tubular channel.

The invention will now be illustrated with reference to the following drawings of an embodiment of the invention.

DETAILED DESCRIPTION OF PREFERRED EMBODIMENTS OF THE INVENTION

Figure 1:
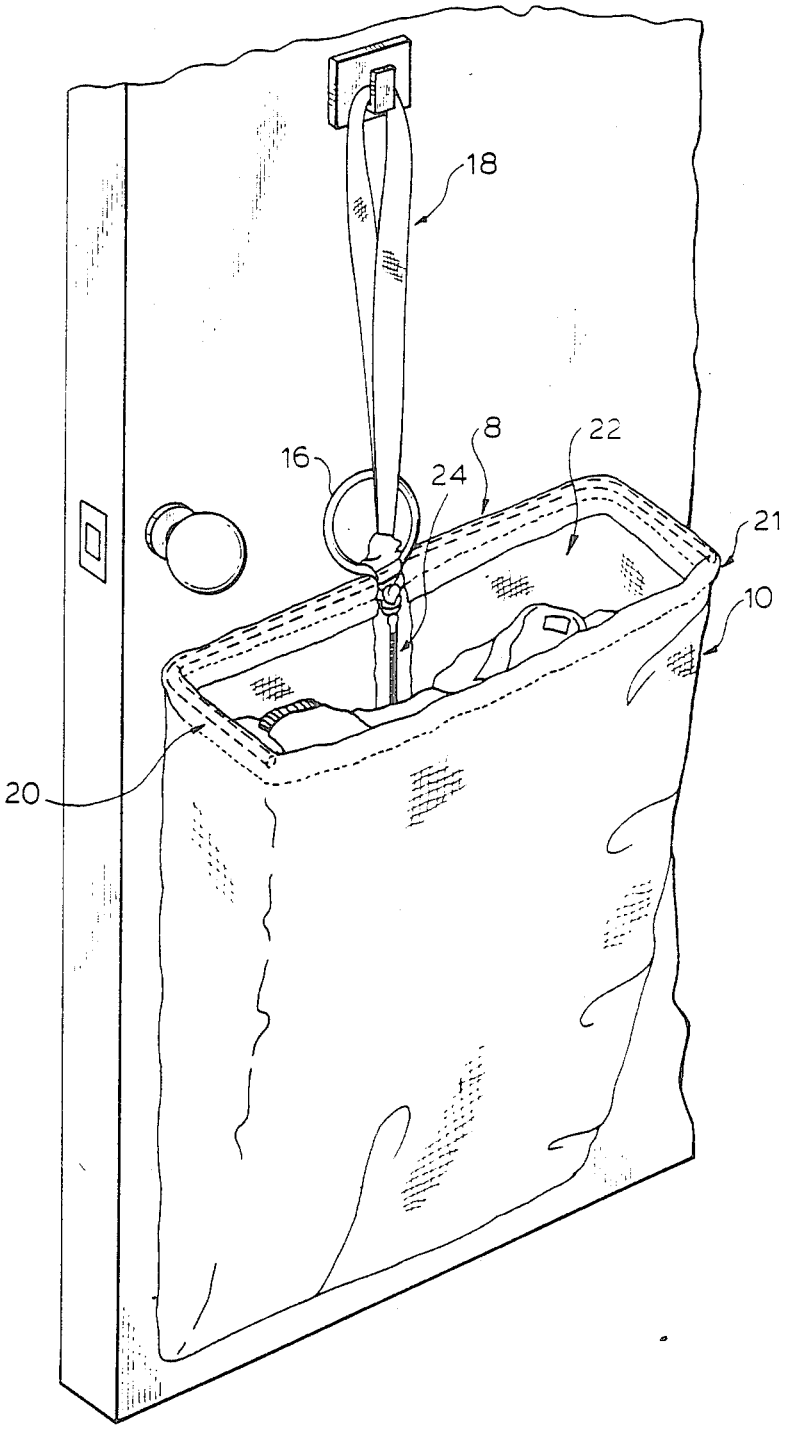
FIG. 1 is a perspective view of a laundry bag, according to one embodiment of the invention.

With reference to FIG. 1, there is shown a suspended laundry bag 9 comprising a nylon bag 10 and a support 8 for carrying nylon bag 10.

Figure 4:
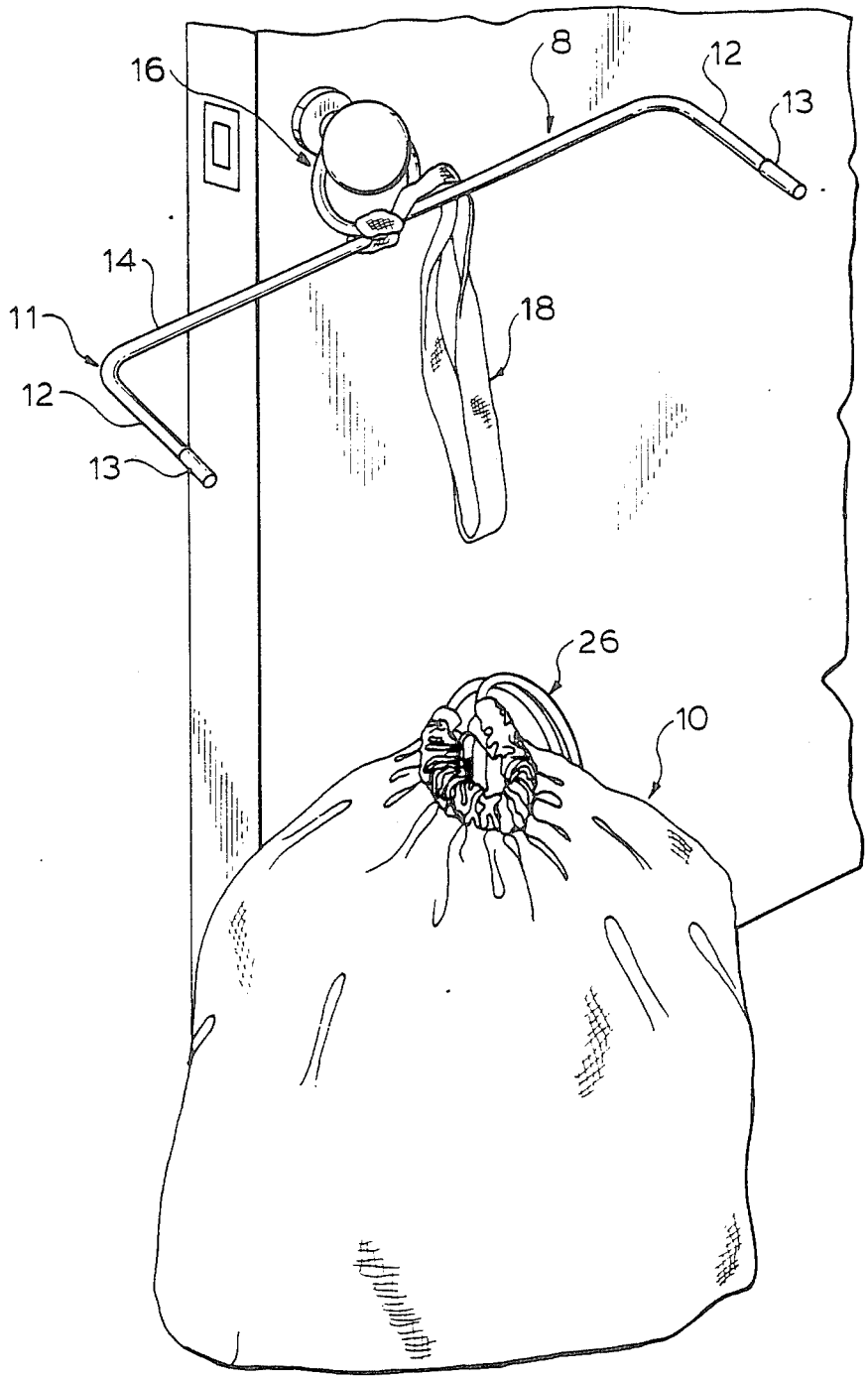
FIG. 4 is a view of the laundry bag detached from its support.
Figure 7:
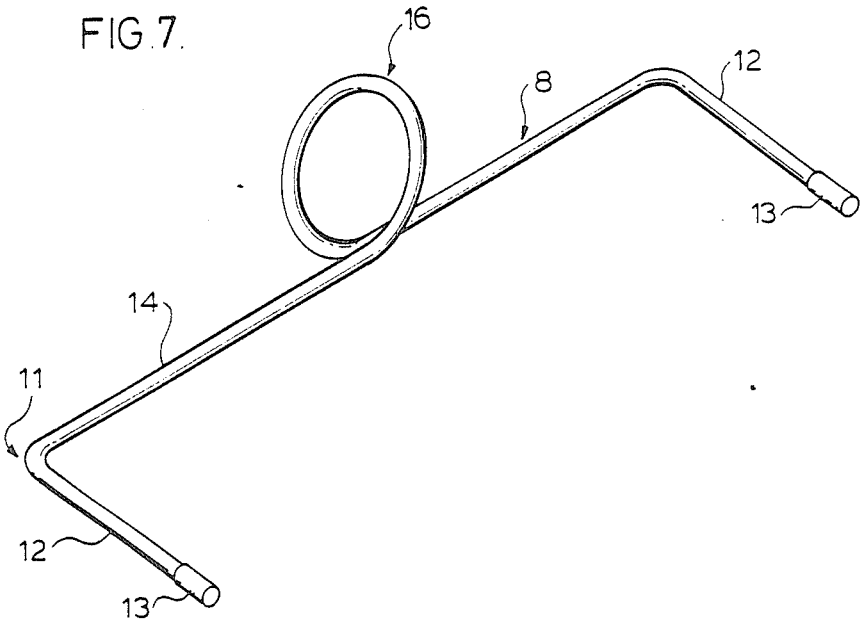
FIG. 7 is a perspective view of the support of the laundry bag used, illustrating the angle of the plane of the loop and plane of the arms.

With reference to FIGS. 4 and 7, support 8 comprises bent steel rod 11 carrying loop 16, connector 14 and two spaced parallel arms 12 at right angles to connector 14. The plane of loop 16 (best seen in FIG. 8) is angled to the plane incorporating arms 12 at an angle of slightly less than 90 degrees, i.e. (80° degrees).

Each of the two spaced parallel arms 12 carries rubber or plastic tips 13 to protect the fabric bag 10 from contact with the ends of the metal arms 12. Connector 14, in addition to carrying loop 16, also carries a fabric handle 18 connected to a portion of loop 16.

Figure 2:
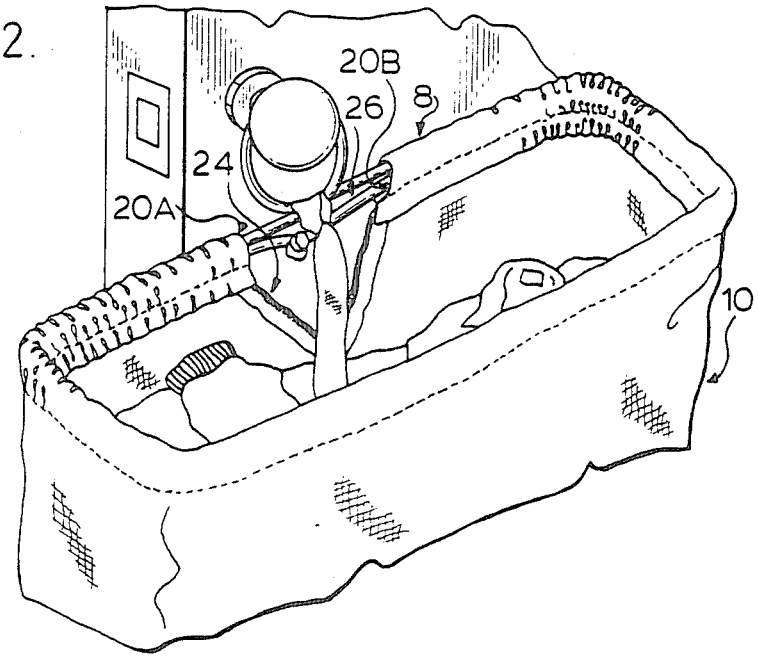
FIGS. 2 and 3 are views of the laundry bag of FIG. 1.
Figure 3:
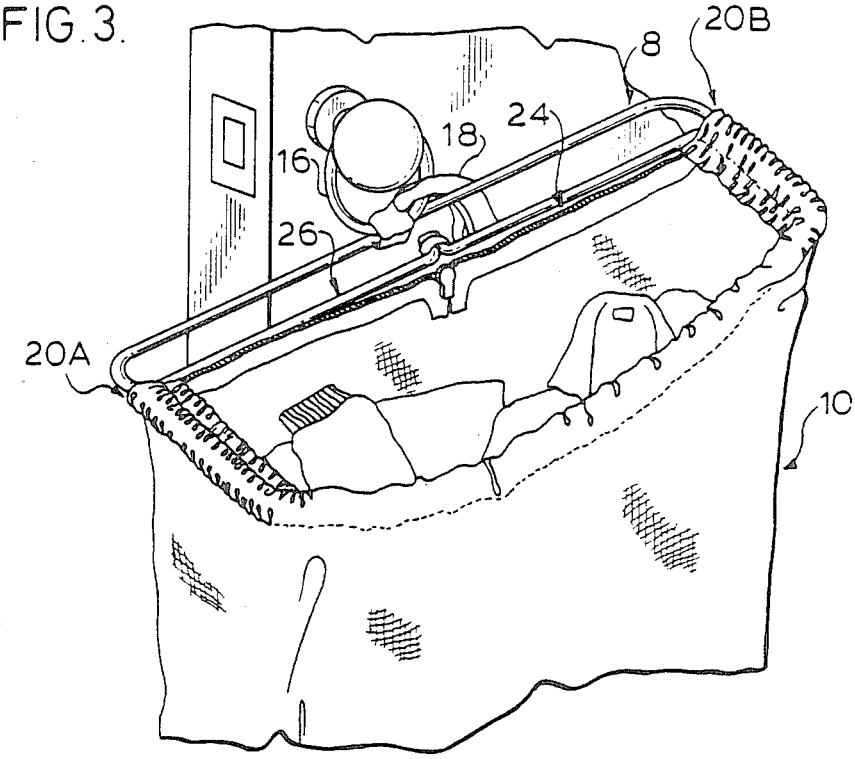

With reference to FIG. 1, support 8 is shown inserted in sleeve or tubular channel 20 formed in the fabric material of the bag at the periphery of bag 10 by folding over of material and securing the material to form sleeve 20 with openings 20A and 20B at either end of sleeve 20 proximate one another. Therefore, after the support is inserted in sleeve 20 until openings 20A and 20B are proximate loop 16, the zippered opening is closed (best shown in FIGS. 2 and 3). With reference to FIGS. 2 and 3, the vertically placed zipper 24 is of sufficient length such that when unzipped, support 8 may be removed by sliding the sleeve material from proximate openings 20A and 20B along connector 14 and arms 12 until support 8 is removed from sleeves.

With reference to FIG. 4, once laundry bag 10 is removed from hanger 8, its mouth 22 may be drawn closed by joining the zipper 24 and gathering the circumference 21 of the mouth 22 of the bag 10 by means of cinching cord 26 carried inside sleeve or tubular channel 20, which also carries support. With reference to FIG. 7, the angle between the plane of loop 16 and arm 12 is shown as 88 degrees. When arms are inserted in sleeve 20 and loop 16 is carried, for example, by any doorknob or hook, the plane of the mouth of the bag is maintained in a substantially horizontal plane for ease of inserting soiled laundry. (best shown in FIGS. 1 and 2)

Figure 8:
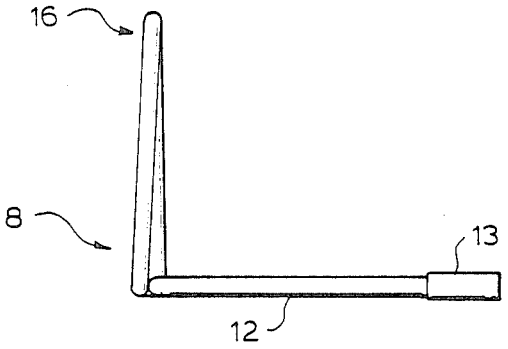
FIG. 8 is a side view of the support shown in FIG. 7.

With reference to FIG. 8, a side view of the support shown in FIG. 7 is shown, whereby the angle between the plane of loop 16 and arms 12 is between about 80° and less than 90 degrees (i.e. 80° degrees).

Figure 5:
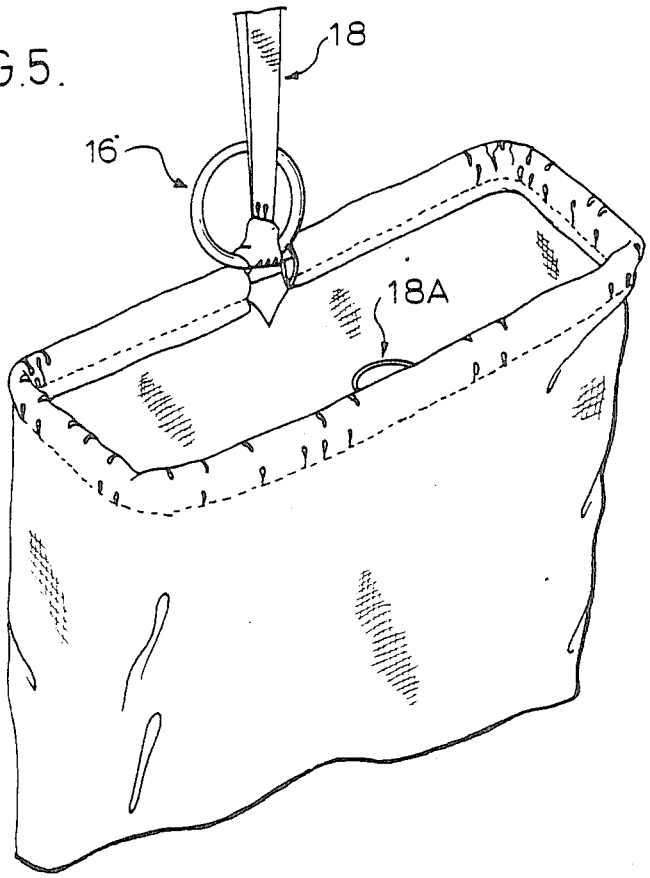
FIG. 5 and 6 are other views showing the laundry bag of FIG. 1 from its support hanger.
Figure 6:
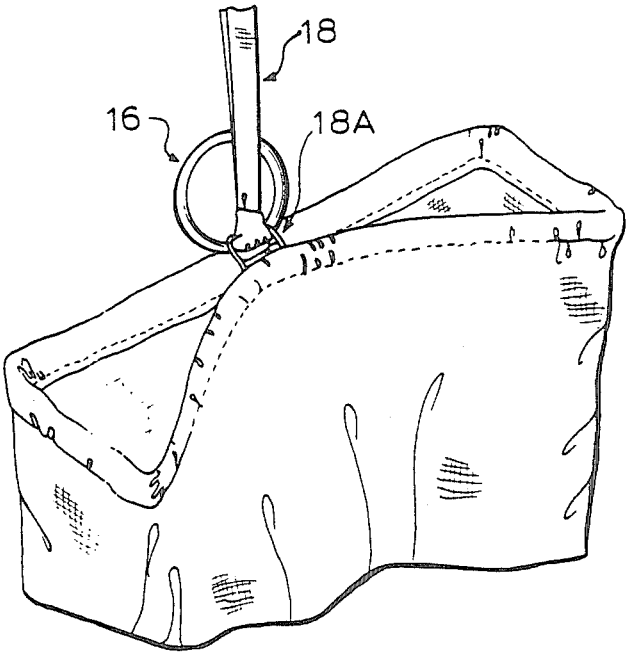

FIGS. 5 and 6 depict a close-up view showing the laundry bag of FIG. 1 suspended by fabric handle 18. Fabric handle 18 is connected to a portion of loop 16. With reference to FIG. 6, closure loop 18A may slide over fabric handle 18 to partially close the mouth of the laundry bag.

As many changes can be made to the embodiment of the invention without departing from the scope of the invention, it is intended that all material contained therein be interpreted as illustrative of the invention and not in a limiting sense.

The embodiments of the invention in which an exclusive property or privilege is claimed are as follows:

1. An improved laundry bag and support therefor comprising: (a) a single piece support having a pair of parallel arms spaced from each other by a connector, the connector carrying a hanger incorporating a loop formed by bending the center of the connector for hanging the laundry bag, the plane of the hanger and the plane in which the pair of parallel arms are disposed creating an angle of slightly less than 90° whereby when the hanger is carried by a carrier the spaced arms are oriented in a predetermined substantially horizontal plane thereby presenting the mouth of the laundry in a substantially horizontal plane; (b) a laundry bag carrying a pair of sleeves proximate the mouth of the bag, the pair of sleeves providing two adjacent openings each opening for receiving one of the two parallel spaced arms; (c) the laundry bag having a zipper opening proximate the pair of sleeves of (b) to permit the two adjacent openings of the pair of sleeves to be spaced apart to permit entry of the two parallel spaced arms into the two openings of the pair of sleeves, whereby the laundry bag may be securely mounted on the support or removed from the support; (d) the pair of sleeves carrying a cinching cord whereby when the zipper is open the laundry bag may be removed from the support and the mouth of the laundry bag cinched closed.

2. An improved laundry bag and support therefor comprising: (a) a single piece support having a pair of parallel arms spaced from each other by a connector, the connector carrying a hanger incorporating a loop formed by bending the center of the connector for hanging the laundry bag, the plane of the hanger and the plane in which the pair of parallel arms are disposed creating an angle of slightly less than 90° whereby when the hanger is carried by a carrier the spaced arms are oriented in a predetermined substantially horizontal plane thereby presenting the mouth of the laundry in a substantially horizontal plane; (b) a laundry bag carrying a pair of sleeves proximate the mouth of the bag, the pair of sleeves providing two adjacent openings each opening for receiving one of the two parallel spaced arms; (c) the laundry bag having a slit opening proximate the pair of sleeves of (b) to permit the two adjacent openings of the pair of sleeves to be spaced apart to permit entry of the two parallel spaced arms into the two openings of the pair of sleeves, whereby the laundry bag may be mounted on the support or removed from the support; (d) the pair of sleeves carrying a cinching cord whereby when the laundry bag is removed from the support the mouth of the laundry bag may be cinched closed.

* * * * *

UNITED STATES PATENT AND TRADEMARK OFFICE

CERTIFICATE OF CORRECTION

PATENT NO. : 4,694,503

DATED : September 15, 1987

INVENTOR(S) : DENNIS HYDORN

It is certified that error appears in the above-identified patent and that said Letters Patent is hereby corrected as shown below:

In Claim 1 of the Patent at column 3, line 33, at the end of that line after 'laundry' and before 'in a', --bag-- should be added.

In Claim 2 of the Patent at column 4, line 21, at the end of that line after 'laundry' and before 'in a', --bag-- should be added.

Signed and Sealed this

Ninth Day of April, 1991

*Attest:*

*Attesting Officer*

HARRY F. MANBECK, JR.

*Commissioner of Patents and Trademarks*